US005852760A

United States Patent [19]

Harris et al.

[11] Patent Number: 5,852,760

[45] Date of Patent: Dec. 22, 1998

[54] TONER CONTAINER WITH SNAP-ON TORQUE BEARING ADAPTOR

[75] Inventors: Michael Harris, Rochester, N.Y.; John D. Sundquist, Clarksville, Va.

[73] Assignee: Xerox Corporation, Stamford, Conn.

[21] Appl. No.: 967,769

[22] Filed: Nov. 10, 1997

[51] Int. Cl.[6] ..... G03G 15/08

[52] U.S. Cl. ..... 399/262; 399/258

[58] Field of Search ..... 399/222, 252, 399/258, 262, 263

[56] References Cited

U.S. PATENT DOCUMENTS

| | | | |
|---|---|---|---|
| 4,878,603 | 11/1989 | Ikesue et al. | 222/167 |
| 4,941,022 | 7/1990 | Ohmura et al. . | |
| 4,990,964 | 2/1991 | Kraehn . | |
| 5,057,872 | 10/1991 | Saijo et al. . | |
| 5,089,854 | 2/1992 | Kaieda et al. . | |
| 5,200,787 | 4/1993 | Nishiguchi . | |
| 5,235,389 | 8/1993 | Kikuchi et al. | 399/263 |
| 5,257,077 | 10/1993 | Peters, Jr. et al. | 399/263 |
| 5,307,129 | 4/1994 | Miura et al. | 399/263 |
| 5,383,502 | 1/1995 | Fisk et al. . | |
| 5,455,662 | 10/1995 | Ichikawa et al. . | |
| 5,495,323 | 2/1996 | Meetze, Jr. . | |
| 5,528,349 | 6/1996 | Satake | 399/262 |
| 5,722,014 | 2/1998 | Fike | 399/262 X |

*Primary Examiner*—Sandra Brase
*Attorney, Agent, or Firm*—John S. Wagley

[57] ABSTRACT

A device for storing a supply of particles for use a developer unit of an electrophotographic printing machine is provided. The device is cooperable with a mechanism to feed the particles from the device into the developer unit. The device includes a container defining a chamber for storing particles therein and a member. The container defines an aperture therein. The member is removably connectable to the container. The member includes a first member feature. The first member feature is engagable with said mechanism for feeding the particles from the device into to the developer unit.

21 Claims, 12 Drawing Sheets

TONER CONTAINER WITH SNAP-ON TORQUE BEARING ADAPTOR

The present invention relates to a developer apparatus for electrophotographic printing. More specifically, the invention relates to a container for storing toner.

Cross reference is made to the following application filed concurrently herewith: U.S. patent application Ser. No. (Attorney Docket Number D/96792) entitled "Toner Container With Foolproof Adaptor" by Michael Harris.

In the well-known process of electrophotographic printing, a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable marking particles typically in the form of a powder known as "toner." Toner is held on the image areas by the electrostatic charge on the photoreceptor surface. Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

In the process of electrophotographic printing, the step of conveying toner to the latent image on the photoreceptor is known as "development." The object of effective development of a latent image on the photoreceptor is to convey developer material to the latent image at a controlled rate so that the developer material effectively adheres electrostatically to the charged areas on the latent image. A commonly used technique for development is the use of a two-component developer material, which comprises, in addition to the toner particles which are intended to adhere to the photoreceptor, a quantity of magnetic carrier granules or beads. The toner particles adhere triboelectrically to the relatively large carrier beads, which are typically made of steel. When the developer material is placed in a magnetic field, the carrier beads with the toner particles thereon form what is known as a magnetic brush, wherein the carrier beads form relatively long chains which resemble the fibers of a brush. This magnetic brush is typically created by means of a "developer roll."

Another known development technique involves a single-component developer, that is, a developer which consists entirely of toner. In a common type of single-component system, each toner particle has both an electrostatic charge (to enable the particles to adhere to the photoreceptor) and magnetic properties (to allow the particles to be magnetically conveyed to the photoreceptor). Instead of using magnetic carrier beads to form a magnetic brush, the magnetized toner particles are caused to adhere directly to a developer roll.

In an electrophotographic printer as the toner within the developer material is transferred to the photoreceptor and eventually to the copy paper, this used toner must be replaced. The electrophotographic printer thus includes a toner container or cartridge from which fresh toner is dispensed into the machine. When using two component developer, a portion of the carrier granules will eventually deteriorate. Additional new carrier granules may be added to the machine to replace the deteriorated granules. The toner container or cartridge may thus alternatively store a mixture including a small quantity of carrier granules in addition to the toner. To provide for a small compact toner cartridge and to provide for a toner cartridge in which the opening to the cartridge may be easily removed, the toner cartridge typically has a compact shape with a small opening from which the toner is dispensed.

Traditionally when all the toner within the container had been consumed, additional toner was supplied to the machine by pouring toner from a separate refilling bottle into the container. This method permitted many toner particles to become airborne during filling and enter the machine. The operator may even miss the opening of the container during filling and spill large quantities of toner inside the machine. Since the toner is inherently very susceptible to electrostatic charges, the toner sticks electrostatically to all the remote recesses of the machine making cleaning of the machine necessary, time consuming, and expensive.

Recently, machines have been supplied with replaceable toner containers or cartridges to avoid some of the problems associated with spilling toner during refilling. While missing the opening of the container during filling and spilling large quantities of toner is alleviated by replaceable toner containers, spillage can occur from the old container during removal and from the new container during installation.

Toner in the toner container or cartridge must be fed therefrom to the latent image to effectuate development. Typically, toner containers are located with their openings in the bottom of the container whereby they may be emptied by gravity. In attempts to make inexpensive and compact electrophotographic printers and to minimize space and related costs, however, the shape of the toner container may not be conducive to a bottom opening or to an unassisted emptying of the container. This is particularly true for wide format copiers and printers. When the opening is not in the bottom or the geometry of the container does not promote the free flow of all the contents, a mechanism must be provided for removing the toner therefrom. While the demand for toner remains fairly constant, these mechanisms expel large quantities of toner when the container is full and progressively smaller amounts as the container empties. Typically the toner containers are cylindrical and the toner is removed therefrom by rotating the container and/or a member within the container, such as a spiral wire, Cylindrical toner containers are now available with spiral ribs located therein, which when rotated urge the toner to the end thereof. These containers have an opening in the periphery of the container near one end thereof through which toner escapes. A machine interface which must be sealed to the container is used to remove toner from the opening. Typically the dispensing hole is covered with a removable seal to contain the toner during shipment. The seal is removed prior to installation of the container. An example of a prior art container is shown in U.S. Pat. No. 5,495,323 to Meetze the relevant portions thereof incorporated herein by reference.

Cylindrical toner containers typically have a longitudinal axis which is horizontally oriented and about which the container rotates. The container is thus driven about the axis by a motor which is connected to the container by a driving feature. The containers are typically manufactured of plastic through a blow molding process wherein the wall of the plastic toner container is quite thin. These thin walled containers typically do not have the rigidity capable of transmitting the torque required to rotate the toner containers. Typically a drive member is connected to the plastic molded toner container by means of rivets or other fasteners.

The blow molded cylindrical plastic toner containers require the use of a large expensive mold from which they are manufactured. Many suppliers of copying and printing machines include in their portfolio a large quantity of varying models of copiers and printers. Each of these particular copiers and printers may utilize a slightly different toner container. The manufacturer of copiers and printers thus may utilize a large number of containers, each requiring its individual expensive mold.

In addition to the tooling cost for a particular blow molded toner container, it is preferred that the toner container, which is blow molded, be manufactured in large quantities or in large lots such that the piece cost per toner container is minimized.

The following disclosures may be relevant to various aspects of the present invention:

U.S. Pat. No. 5,495,323
Patentee: Meetze
Issue Date: Feb. 27, 1996

U.S. Pat. No. 5,455,662
Patentee: Ichikawa et al.
Issue Date: Oct. 3, 1995

U.S. Pat. No. 5,383,502
Patentee: Fisk et al.
Issue Date: Jan. 24, 1995

U.S. Pat. No. 5,200,787
Patentee: Nishiguchi
Issue Date: Apr. 6, 1993

U.S. Pat. No. 5,089,854
Patentee: Kaieda et al.
Issue Date: Feb. 18, 1992

U.S. Pat. No. 5,057,872
Patentee: Saijo et al.
Issue Date: Oct. 15, 1991

U.S. Pat. No. 4,990,964
Patentee: Kraehn
Issue Date: Feb. 5, 1991

U.S. Pat. No. 4,941,022
Patentee: Ohmura et al.
Issue Date: Jul. 10, 1990

U.S. Pat. No. 4,878,603
Patentee: Ikesue et al.
Issue Date: Nov. 7, 1989

The relevant portions of the foregoing disclosures may be briefly summarized as follows:

U.S. Pat. No. 5,495,323 discloses a device for storing a supply of particles for use in a developer unit of an electrophotographic printing machine. The device comprises an open ended container defining a chamber in communication with the open end thereof. The particles are stored in the chamber of the container. The device further comprises a puncturable seal attached to the open end of the container for sealing the chamber. The container is installable into the developer unit without removal of the seal.

U.S. Pat. No. 5,455,662 discloses a developer replenishing device for replenishing a developing device with a developer and a developer container for use therewith. The developer container or toner bottle has a mouth portion at one end thereof which is smaller than in diameter than a hollow cylindrical main body. At the end of the bottle provided with the mouth, a shoulder has the inner periphery thereof partly raised to the edge of the mouth portion to form a raised portion for scooping up toner.

U.S. Pat. No. 5,383,502 discloses an imaging material replenishing system including a toner container 12 removably insertable into an insertion guide member 16. The container 12 has a containment lid unit 20 which is automatically opened upon insertion. A lid latching member 30 which includes a lid latching notch 34 normally latches the containment lid to the container 12.

U.S. Pat. No. 5,200,787 discloses a developing unit 10 including a valve 40 at the junction of the first toner transport channel 27 and the second transport channel 30. The valve 40 is normally closed, but is opened when the toner collection bottle has been filled.

U.S. Pat. No. 5,089,854 discloses a device for assisting the removal of toner from a toner bottle. The device includes a vertically oriented toner bottle having an opening formed in a cap portion at its lower end and a bellows which may be extended or shrunk by pushing the top portion of the toner bottle downward to eject toner in the bottle out of the bottle.

U.S. Pat. No. 5,057,872 discloses a developer supplying device which includes a substantially cylindrical developer container having on its peripheral surface a spiral groove and being able to rotate to transport a developer therein by the groove. The device includes a supplying element in the form of an opening and a regulating device.

U.S. Pat. No. 4,990,964 discloses a toner delivery system including a toner bottle having an opening in the top end thereof. The toner is removed from the bottle by a vertically oriented suction spout to which a bellows is attacked for extracting the toner therefrom. A handle is located above the bellows and attached thereto to assist an operator in manually actuating the bellows.

U.S. Pat. No. 4,941,022 discloses a toner recovery device for collecting toner from a cleaning device into a recovered toner container 32. The recover opening 323 of the container 32 is covered with a shutter. The shutter is opened and closed by an operating lever 42.

U.S. Pat. No. 4,878,603 discloses a toner replenishing device for replenishing toner to a toner storage area, from where the toner is supplied to a developing section. The device includes a holder for releasably holding a cartridge containing therein a quantity of toner. The holder may be located at a cartridge mounting and dismounting position and at a replenishing position. The cartridge is held substantially horizontally and driven to rotate thereby discharging the toner to a toner transporting path leading to the toner storage area. The cartridge is provided with a first mating member and the holder is provided with a second mating member corresponding in position and receiving the first mating member.

According to the present invention, there is provided a device for storing a supply of particles for use a developer unit of an electrophotographic printing machine. The device is cooperable with a mechanism to feed the particles from the device into the developer unit. The device includes a container defining a chamber for storing particles therein and a member. The container defines an aperture therein. The member is removably connectable to the container. The member includes a first member feature. The first member feature is engagable with said mechanism for feeding the particles from the device into the developer unit.

According to the present invention, there is also provided a developer unit for developing a latent image recorded on an image receiving member of an electrophotographic printing machine with a supply of particles. The developer unit includes a device for storing the supply of particles. The device is cooperable with a mechanism to feed the particles from the device into the developer unit. The device includes a container defining a chamber for storing particles therein and a member. The container defines an aperture therein. The member is removably connectable to the container. The member includes a first member feature. The first member feature is engagable with said mechanism for feeding the particles from the device into the developer unit.

According to the present invention, there is further provided an electrophotographic printing machine for developing with a supply of particles a latent image recorded on an image receiving member. The copy machine including a developer unit. The developer unit includes a device for storing the supply of particles. The device is cooperable with a mechanism to feed the particles from the device into the developer unit. The device includes a container defining a chamber for storing particles therein and a member. The container defines an aperture therein. The member is removably connectable to the container. The member includes a first member feature. The first member feature is engagable with said mechanism for feeding the particles from the device into the developer unit.

IN THE DRAWINGS

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 13 printing machine will be shown hereinafter schematically and their operation described briefly with reference thereto.

Figure 14:
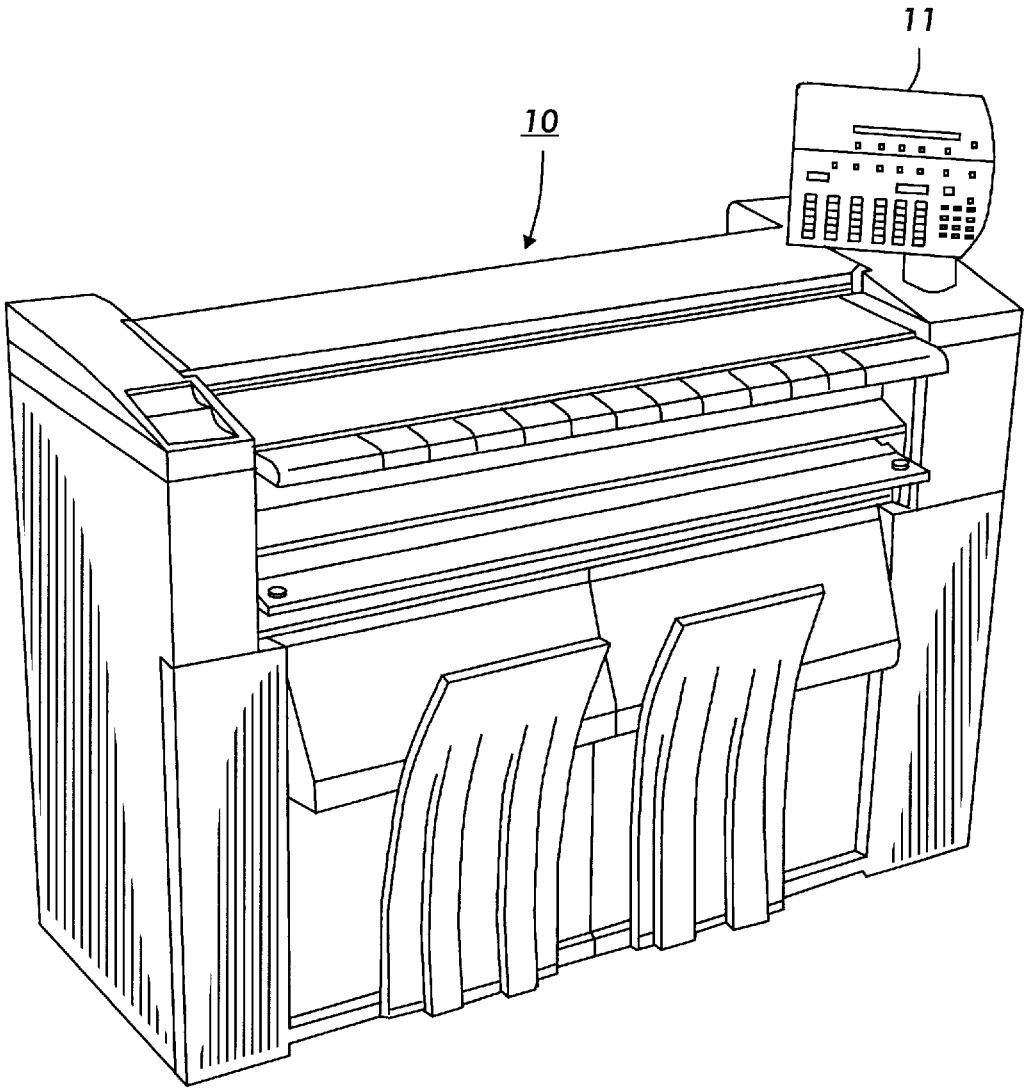
FIG. 14 is a perspective view of an illustrative electrophotographic printing machine incorporating the toner container with removable adaptor of FIG. 1.
Figure 15:
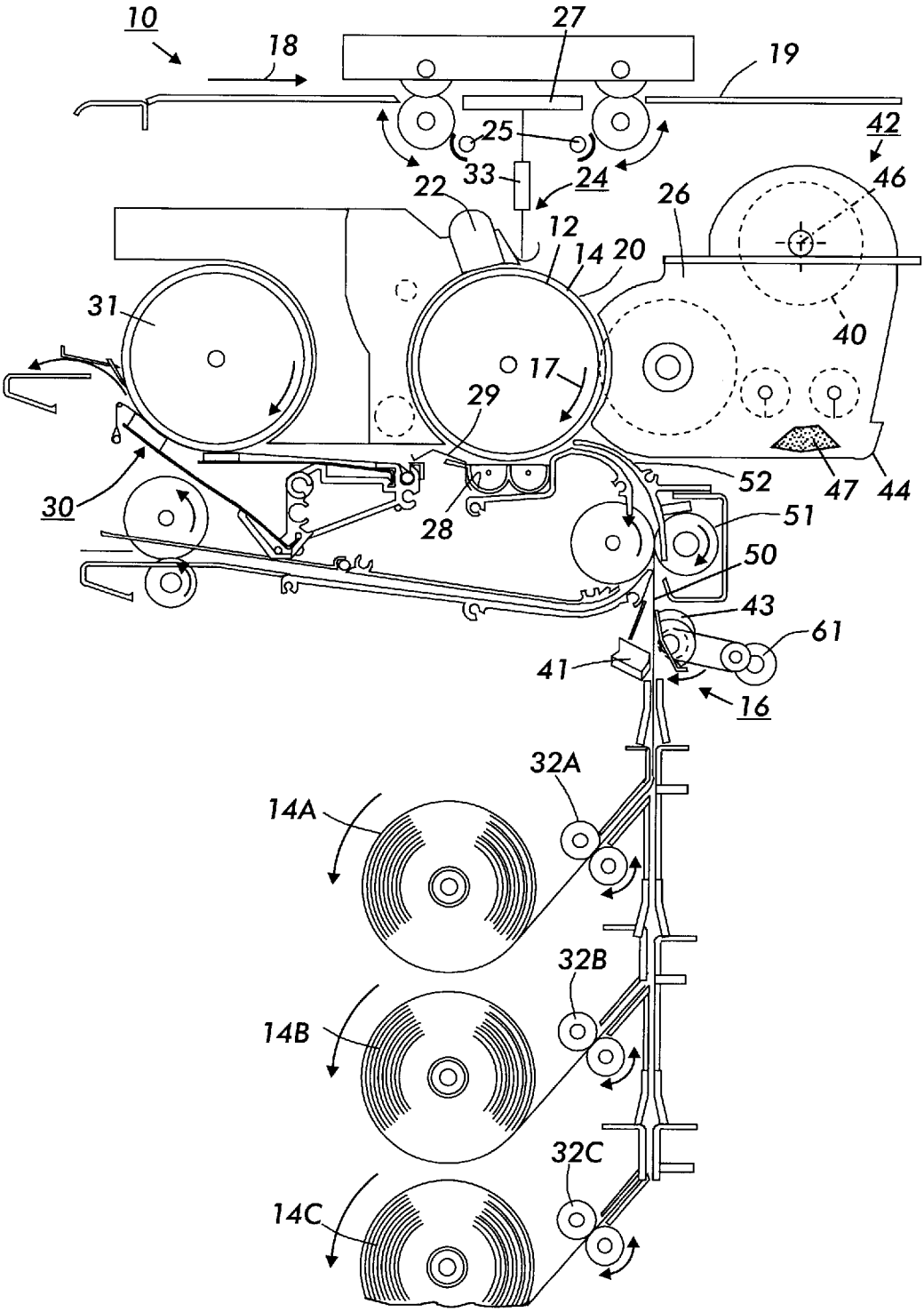
FIG. 15 is a schematic elevational view of the illustrative electrophotographic printing machine of FIG. 14.

Referring to FIGS. 14 and 15 of the drawings there is shown by way of example an automatic xerographic reproduction or printing machine, designated generally by the numeral 10 incorporating the post transfer corrugator structure of the present invention.

Referring now to the drawings in detail wherein like numbers represent like elements, in FIG. 14 a wide format copier/printer 10 including a control panel 11 is shown which is especially adapted to copy large documents. Documents to be copied are fed in from the front of the machine, pass through an exposure zone and exit out of the back of the machine.

FIG. 15 shows a side internal view of the copier/printer machine 10. Machine 10 includes an electrostatic drum 20 with xerographic stations arranged around its periphery, which carry out the operational steps of the copying process. These stations include charging station 22, exposure station 24, developing station 26, transfer station 28 and fusing station 30.

Documents fed along platen 19 in the direction of arrow 18 are imaged onto the surface of drum 20, at exposure station 24. The operations of the stations are conventional and are described, for example, in U.S. Pat. Nos. 4,821,974; 4,996,556; and 5,040,777, whose contents are incorporated herein by reference.

Copy media, which may be bond paper, vellum, or the like, is cut from the selected media roll assembly 14A, 14B or 14C and is fed by a respective feed roller pair 32A, 32B or 32C. The sheet to be cut is guided along a vertical path between baffle pairs into sheet cutting bar assembly 16 which includes a stationary blade 41 and a rotating cutting bar 43 that includes a helical cutting blade. Cutter bar 43 is shown in the home position which is about 30° of rotation away from the cutting position and is driven by motor 61. Cutter assembly 16 is of the conventional type described, for example, in U.S. Pat. No. 4,058,037. Initiated by a cutter operation signal, bar 43 rotates in the direction of the arrow with its blade moving against blade 41 to sheer a sheet 50 from the roll media with a straight cut. The cut sheet is transported after registration by roller pair 51 into baffle 52 and then into transfer station 28 where a developed image is transferred onto the sheet. The cut sheet is then forwarded over post transfer corrugator 29, through fuser 31 at fuser station 30 and out of the machine. It should be appreciated that the printing machine may likewise include a photoreceptor in the form of a belt (not shown) in place of the drum 20. The drum 20 has a photoconductive surface layer 12 on an electroconductive substrate 14. Preferably the surface 12 is made from a selenium alloy. The substrate 14 is preferably made from an aluminum alloy which is electrically grounded. The drum is driven by means of motor (not shown), the direction of movement being clockwise as viewed and as shown by arrow 17. Initially a portion of the drum 20 passes through a charge station 22 at which a corona generator (not shown) charges surface 12 to a relatively high, substantially uniform, potential.

Next, the charged portion of photoconductive surface 12 is advanced through exposure station 24. At exposure station 24, imaging of the document is achieved by lamps 25 which illuminate the document on a platen 27. Light rays reflected from the document are transmitted through lens 33. Lens 33 focuses light images of the document onto the charged portion of the photoconductive drum 20 to selectively dissipate the charge thereon. This records an electrostatic latent image on the photoconductive belt which corresponds to the informational areas contained within the original document. Thereafter, drum 20 advances the electrostatic latent image recorded thereon to development station 26.

After the electrostatic latent image has been recorded on photoconductive surface 12, drum 20 advances the latent image to development station 26 as shown in FIG. 15. The development station 26 develops the latent image recorded on the photoconductive drum 20. The chamber in developer housing 44 stores a supply of developer material 47. The developer material may be a two component developer material of at least magnetic carrier granules having toner particles adhering triboelectrically thereto. It should be appreciated that the developer material may likewise comprise a one component developer material consisting primarily of toner particles.

Again referring to FIG. 15, after the electrostatic latent image has been developed, drum 20 advances the developed image to transfer station 28, at which a copy sheet is advanced by rollers 51 and baffle 52 into contact with the developed image on drum 20. A corona generator is used to spray ions onto the back of the sheet so as to attract the toner image from drum 20 onto the sheet. As the drum 20 turns, the sheet is stripped therefrom with the toner image thereon.

After transfer, the sheet is advanced by a conveyor (not shown) to fusing station 30. Fusing station 30 includes a heated fuser 31. The sheet passes fuser roller 31 with the toner powder image contacting fuser roller 31. In this way, the toner powder image is permanently affixed to the sheet. After fusing, the sheet advances for subsequent removal from the printing machine by the operator.

After the sheet is separated from photoconductive surface 12 of drum 20, the residual toner particles adhering to photoconductive surface 12 are removed therefrom at cleaning station (not shown) by a rotatably mounted fibrous brush in contact with photoconductive surface 12. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present invention therein.

Referring again to FIG. 15, a particle storage device 40 is shown. The particle storage device 40 is located within developer unit 42 and is secured to developer housing 44. The particle storage device 40 is positioned relative to the horizontal such that longitudinal axis 46 of the device 40 is located horizontally. The horizontal orientation of the storage device 40 is particularly well suited for copying large documents. In machines for copying large documents, the drum 20 is by necessity long and thus typically the machine has an extended length in the horizontal longitudinal axis. This necessitates a longitudinally extended developer unit shape. A longitudinally extending storage device 40 is the thus the most efficient shape for this developer unit.

Figure 1:
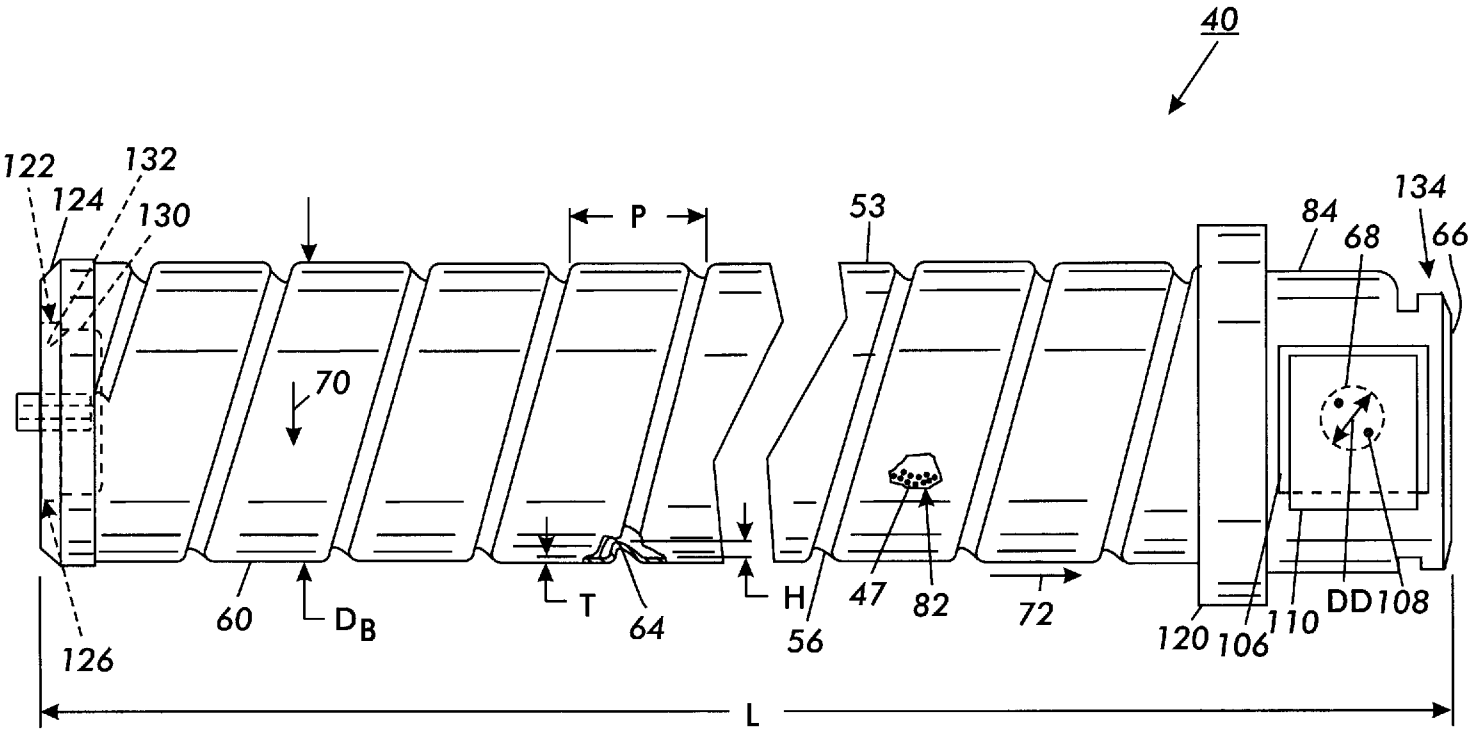
FIG. 1 is a plan view of the toner container for use with the present invention.

Referring now to FIG. 1, the device 40 includes a container 53 defining an aperture 68 in the form of an opening through which developer material 47 including at least marking particles is dispensed.

The container 53 may have any suitable shape and configuration capable of containing the developer material 47. For example, the container 53 may have a generally cylindrical shape and contain within the hollow container 53 a spirally shaped spring or auger (not shown) for urging the developer material 47 within the container 53 toward the developer housing 44 (see FIG. 1). Preferably, however, the container 53 includes spiral ribs 56 formed in periphery 60 of the container 53. Such a container with integral spiral ribs is disclosed in U.S. Pat. No. 5,495,323 to Meetze, Jr., the relative portions thereof incorporated herein by reference.

The container 53 may be supported by supports (not shown) in the form of a V or similarly shaped cradle. The container 53 may thus be replaced by lifting the container 53 in a vertical direction away from the cradle.

The internal periphery 64 of the spiral ribs 56 which are located on periphery 60 of the container 53 urge the material 47 toward dispensing end 66 of the container 53. The container 53 is rotated in the direction of arrow 70 whereby the spiral ribs 56 progress the material 47 in the direction of arrow 72.

Figure 7:
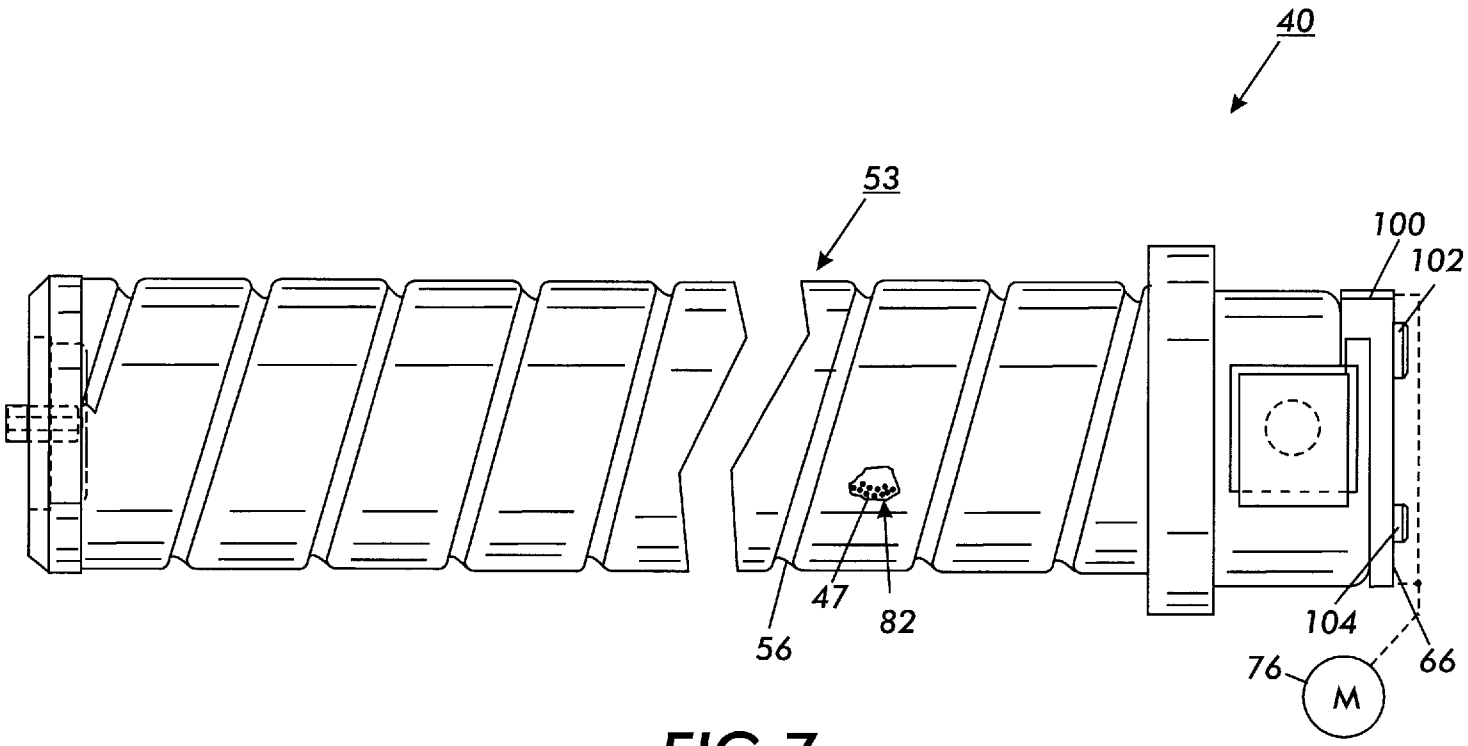
FIG. 7 is a plan view of the toner container of the present invention showing a first adapter positioned thereon.

Referring now to FIG. 7, the container 53 is rotated by any suitable device for example a drive motor 76 or by a common motor (not shown) connected to the container 53 by a drive train (not shown). The drive motor 76 may be connected to the container 53 by any suitable method, but preferably, is connected by primary drive pin 102 and secondary drive pin 104 located on drive cap 100.

Referring again to FIG. 1, the container 53 is shown in greater detail. The container 53 may have any suitable size necessary to store a sufficient quantity of developer material 47 within chamber 82 of the container 53. For example, the container 53 may have a length L of approximately 33 inches and a diameter $D_B$ across the external periphery 60 of the container 53 of approximately 3 inches.

The ribs 56 form an internal protrusion or height H along which the material 47 progress. The height H may be any suitable height necessary to translate sufficient quantities of developer material 47 toward dispensing end 66 of the container 53. For example, the height H may be approximately 0.2 inches. To provide for a sufficient quantity of material 47 progressing toward the dispensing end 66 of the container, the pitch P or distance between adjacent ribs 56 may be adjusted to provide for a larger or smaller quantity of material 47 moving toward the dispensing end 66. For example, the pitch P may be approximately 1.37 inch.

The container 53 may be made of any suitable durable material and may for example be made of acetyl or polyethylene. The container 53 may likewise be made of a glass filled polycarbonate for increased strength. When made of acetyl or polyethylene, the container 53 may have a thickness T sufficient to maintain the strength of the container 53, for example, the thickness T may be approximately 0.020 to 0.050 inches.

The container 53 may be made by any suitable method, for example, the container 53 may be blow molded by a suitable blow molding process. Such a process is described in U.S. Pat. No. 4,101,617 to Friedrich, the relative portions thereof incorporated herein by reference.

To permit the material 47 to exit the container 53, the container 53 includes the dispensing opening 68 from which the material 47 is dispensed from the container 53. The opening 68 may have any suitable shape, for example, include a round aperture or square or rectangular aperture. The cross sectional area of the opening 68 is selected to provide for the proper amount of material 47 to be distributed from the container depending on the need of the copy machine (not shown). The opening 68 is preferably located on periphery 84 of the dispensing end 66 of the container 53. The container 53 may be integrally molded or may include a dispensing portion (not shown) which includes the opening 68 connected to a spiral portion (not shown) which includes the integrally molded ribs 56.

With each rotation of the container 53 in the direction of arrow 70, the opening 68 moves from an opening upward position toward an opening downward position and back to an opening upward position. With each rotation of the container 53, the opening thus cycles about the periphery 84 of the container 53 permitting a defined amount of material 47 to be dispensed from the container 53.

The dispensing opening 68 may have any suitable size and shape capable of dispensing the proper amount of developer material 47 with each rotation of the toner container 53. For example, as shown in FIG. 1, the dispensing opening 68 may be circular and have a diameter DD of approximately 0.6 inches.

To more accurately control the dispersing of developer material 47 through the dispensing opening 68, preferably, the dispensing opening 68 is covered by a perforated strip 106 which is secured to the outer periphery 84 of the dispensing end 66 of the toner container 53.

The perforated strip 106 is secured to the outer periphery 84 by any suitable method, for example by a glue. The perforated strip may be made of any suitable durable material, for example a plastic, such as Mylar™. The perforated strip includes a plurality of through holes 108. The holes 108 may have any suitable diameter and may be for example a series of small and medium sized holes with diameters of say for example 0.05 and 0.08 inches, respectively.

The device 40 may include a temporary seal 110 for sealing the material 47 within the container 53 during shipment. For example, the container 53 may have the opening 68 at the dispensing end 66 covered by a removable cover seal 110 adhesively applied to the container 53. The cover seal may be made of any suitable material, for example a plastic, such as Mylar™. The cover seal 110 may alternatively be made of a gas permeable material. For example the cover seal 110 may be made of TYVEC®, a product of E. I. duPont de Nemours and Company.

Referring again to FIG. 15, the particle storage device 40 may be installed within the developer housing 44 in any suitable fashion. For example as shown in FIG. 15, the developer housing 44 may include a cover 114 which is removably fitted to base 116. The cover 114 is thus either lifted or hinged away from base 116 to provide access for removal and installation of the particle storage device 40 into the developer housing 44. A portion of the particle storage device 40 may be in communication with the developer chamber 47 and the remainder of the particle storage device 40 may be separated from the developer chamber 44.

Referring again to FIG. 1, in order to isolate the dispensing end 66 of the particle storage device 40 from the remainder of the particle storage device, and to prevent the leaking of developer material 47 from the developer housing 44, the particle storage device 40 preferably includes a developer housing seal 120 which cooperates with the cover 114 and the base 116 of the developer housing 44 to seal the developer material 47 within the dispensing and 116 of the particle storage device 40.

The developer housing seal 120 may have any suitable shape and for example may be in the form of a cylindrical ring which is matingly fitted with the outer periphery 60 of the toner container 53. The developer housing seal 120 may be made of any suitable durable material. For example, a plastic. Such a plastic may be in the form a foam material, for example polypropylene.

Preferably, to assist in the efficient filling of the particle storage device 40, preferably, the toner container 53 includes a fill opening 122 located in the filling end 124 of the toner container opposed to the dispensing end 66 of the toner container 53. The fill opening 122 may have any size sufficient to provide for quick efficient filling of the developer material 47 into the particle storage device 40. Upon filling of the developer material 47 into the chamber 82 of the particle storage device 40, the fill opening 122 is sealed by any suitable method. For example, the fill opening 122 may be sealed by use of a plug 126. The plug 126 may be a simple cylindrical disk which is welded or glued to the toner container 53 or as shown in FIG. 1, include a cylindrical plug including an outer periphery 130 which is in contact with the periphery 132 of the fill opening.

According to the present invention and referring again to FIG. 1, the particle storage device 40 includes a container interlock feature 134 to provide for an ability for the particle storage device 40 to be rotated. The toner container 53 of the particle storage device is preferably made of a durable light weight plastic such as HDPE or high-density polyethylene which while inexpensive is structurally relatively weak.

The applicants have found that a more structurally sound component is required to transmit the torque necessary to rotate the particle storage device 40 when filled with developer material 47. A drive cap 100 as shown in FIG. 7 has been found by the applicants to serve the purpose of transferring the torque to permit rotation of the particle storage device 40.

Referring again to FIG. 1, the drive cap 100 of FIG. 7 is preferably secured to the toner container 53 by means of a drive cap interlock feature 136 which is connected to container interlock feature 134 which features 134 and 136 permit connection with no tools, fasteners or adhesives.

Figure 2:
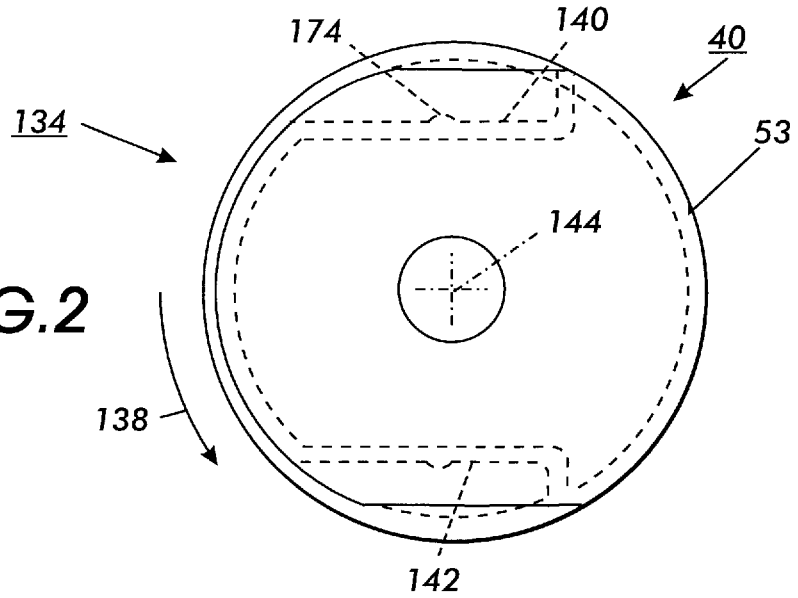
FIG. 2 is an end view of the FIG. 1 toner container showing the end of the container to which the adaptor is installed.

Referring now to FIG. 2 the container interlock feature 134 is shown in greater detail. The container interlock feature 134 is preferably integrally molded with the toner container 53. The container interlock feature 134 preferably includes a feature conducive to transferring the rotational torque created during the rotation of the toner container in the direction as shown in arrow 138. While the invention may be practiced with a single rotational torque feature, preferably, the container interlock feature 134 includes a first drive land 140 and a second drive land 142. The first and second drive lands 140 and 142 may have any suitable shape. For example the lands 140 and 142 may be in the form of grooves formed in the periphery of the toner container 53. The first and second drive lands 140 and 142 are preferably positioned normal or perpendicular to centerline 144 of the toner container 53. Preferably, the first drive land 140 is parallel to the second drive land 142 and the first and second drive lands 140 and 142 are preferably positioned an equidistant from the centerline 144. By symmetrically positioning the first and second drive lands 140 and 142 the torque transmitted through the drive lands 140 and 142 are equal and opposite and thus most efficiently transfer the torque to the toner container 53.

Figure 3:
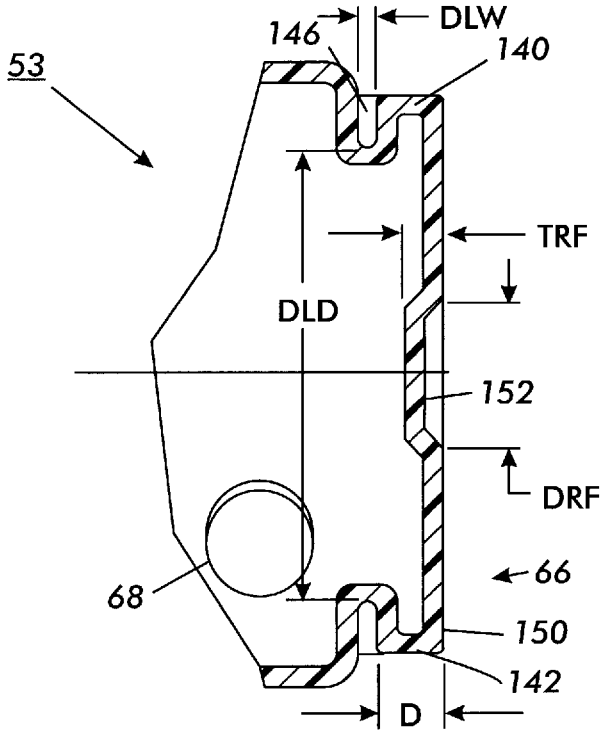
FIG. 3 is a partial plan view of the FIG. 1 toner container partially in section showing the end of the container to which the adaptor is installed.

Referring now to FIG. 3 the drive lands 140 and 142 are shown in greater detail. While the drive lands 140 and 142 may be positioned anywhere along the length of the toner container 53 preferably, as shown in FIG. 3, the drive lands are positioned adjacent the dispensing end 66 of the toner container 53. The drive lands 140 and 142 form grooves 146 in the periphery of the toner container 53. The grooves 146 cooperate with the drive cap 100 (see FIG. 7) to transmit torque from the drive cap 100 to the toner container 53.

The grooves 146 have any suitable width capable of containing the drive cap 100. For example the grooves 146 may have a width DLW of, for example, 0.08 inches. The grooves 146 are preferably parallel to each other and spaced apart a distance DLD. For example the distance DLD may be approximately 1.93 inches. The first drive land 140 and the second drive land 142 may be positioned any where along the length of the toner container 53. Preferably the grooves 146 are adjacent dispensing 66 of container 53. For example, the grooves 146 may be spaced a distance D from dispensing end face 150 of the container 53.

To strengthen the dispensing end face 150 of the toner container 53, preferably the dispensing end face 150 includes a recess 152 extending inwardly from the dispensing end face 150. The recess may have any suitable shape and for example may be circular with a diameter DRF of, for example, approximately 0.62 inches. The recess 152 may extend inwardly from the dispensing end face 150 a distance TRF of approximately 0.06 inches.

Figure 4:
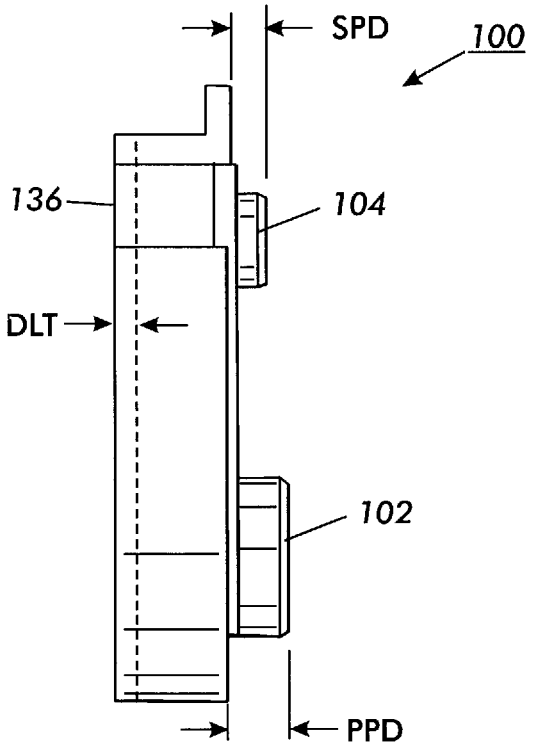
FIG. 4 is an end view of the first adapter of FIG. 1.

Referring now to FIG. 4 the drive cap 100 is shown in greater detail. The drive cap 100 may have any suitable shape compatible with the toner container 53 and mountable thereto. The drive cap 100 may be made of any suitable durable material with sufficient strength to drive a full container 53, for example, a metal or a plastic. For example, the drive cap 100 may be made of a high density polyethylene. The drive cap 100 preferably includes the drive cap interlock feature 136 which cooperates with the first drive land 140 and second drive land 142 of the container interlock feature 134 of container 53. The drive cap interlock feature 134 thus has a thickness DLT which cooperates with the width DLW of the toner container 53. Thus for a toner container having a groove 146 with a width DLW of approximately 0.8 inches, the thickness DLT of the cap interlock feature 136 has a similar thickness of approximately 0.08 inches.

The drive cap 100 further includes a feature in the form of a primary drive pin 102. The primary drive pin provides for a interconnection with the motor 76 (see FIG. 7) for rotating the toner container 53. The primary drive pin 102 may have any suitable shape and may for example be in the form of a cylinder. The primary drive pin may have a depth PPD of approximately 0.27 inches.

The drive cap 100 preferably includes a secondary drive pin 104 in addition to the primary drive pin 102. The secondary drive pin 104 serves to assist in the rotation of the drive cap 100. The secondary drive pin 104 may have any suitable shape and may for example be in the form of a cylinder with a depth SPD of approximately 0.18 inches.

Figure 5:
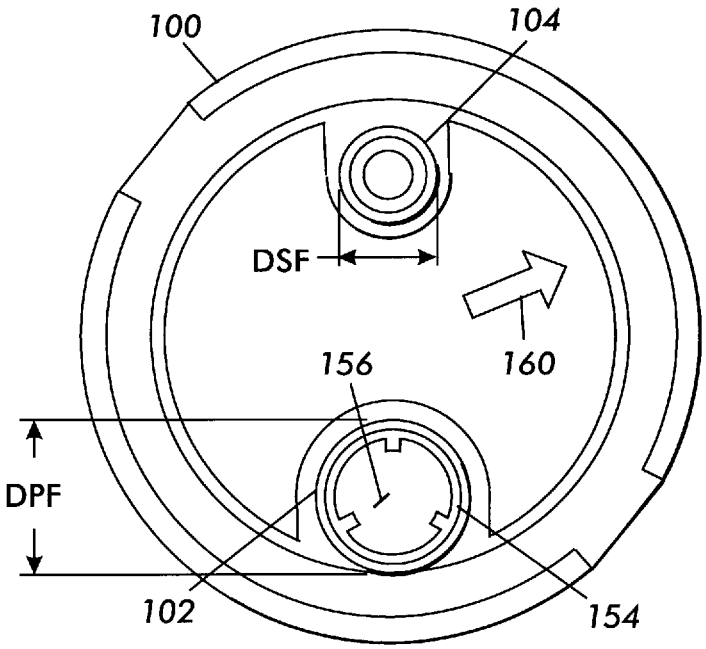
FIG. 5 is a plan view of the first adapter of FIG. 4.

Referring now to FIG. 5 the drive cap 100 is shown in greater detail. The primary drive pin 102 if cylindrical in shape may have a diameter DPF of approximately 0.788 inches. The primary drive pin 102 may be hollow and include a pocket 154 for securing a magnet 156 therein. The magnet may serve to monitor the orientation of the drive cap 100 and may cooperate with a magnetic pickup (not shown). The secondary drive pin 104 if cylindrical in nature may have a diameter DSF of approximately 0.4 inches. The drive cap 100 may also include an installation assistance arrow 160 to assist the operator in orienting the particle storage device 40 in the proper direction.

Figure 6:
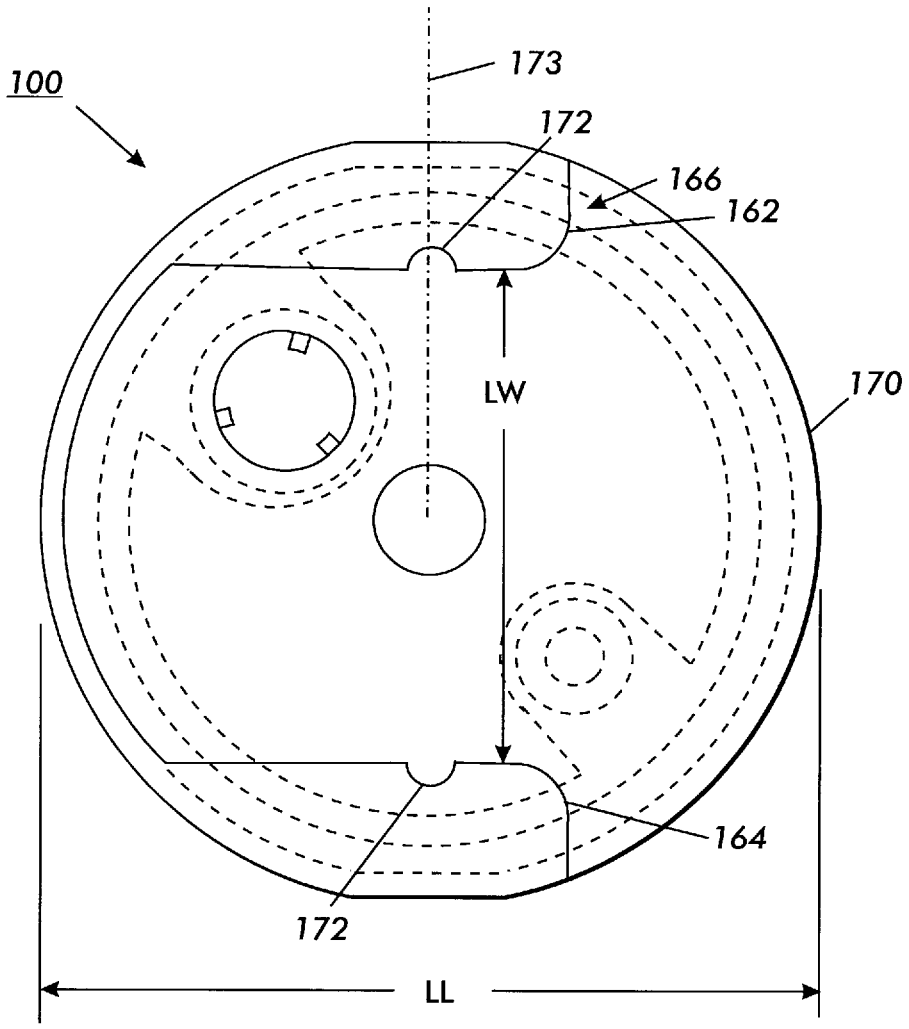
FIG. 6 is a rear view of the first adapter of FIG. 4.

Referring now to FIG. 6 the drive cap interlock feature 136 of the drive cap 100 is shown in greater detail. The interlock feature 136 may have any suitable shape and may be in the form of a solitary lip or as shown in FIG. 6 in the form of a pair of lips including a first lip 162 and a second lip 164 spaced from the first lip 162. The first lip 162 and the second lip 164 form channels 166 between the lips 162 and the body 170 of the drive cap 100. The lips 162 and 164, when the drive cap 100 is installed into the toner container 53, fit within the grooves 146 of the toner container 53. The lips 162 and 164 are separated from each other a distance LW.

For a drive cap 100 with first and second lips 162 and 164 separated a distance LW of approximately 1.93 inches, the grooves 146 of the toner container 53 are separated a distance DLD of also approximately 1.93 inches.

Preferably, to assist in the securing of the drive cap 100 to the toner container 53 the drive cap 100 includes pockets 172 formed inwardly from the first lip 162 and the second lip 164. The pockets 172 are positioned preferably centrally along vertical center line 173 of the drive cap 100. The pockets 172 mate with bumps 174 formed within the drive lands 142 and 140 of the toner container 53 (see FIG. 2).

Referring again to FIG. 6, the drive cap 100 has a diameter L of, for example, three inches or a dimension similar to dimension $D_B$ of the toner container 53 (see FIG. 1).

Referring now to FIG. 7, the drive cap 100 is shown installed onto the toner container 53 to form the particle storage device 40. The drive cap 100 is preferably mechanically connected to the motor 76.

Figure 8:
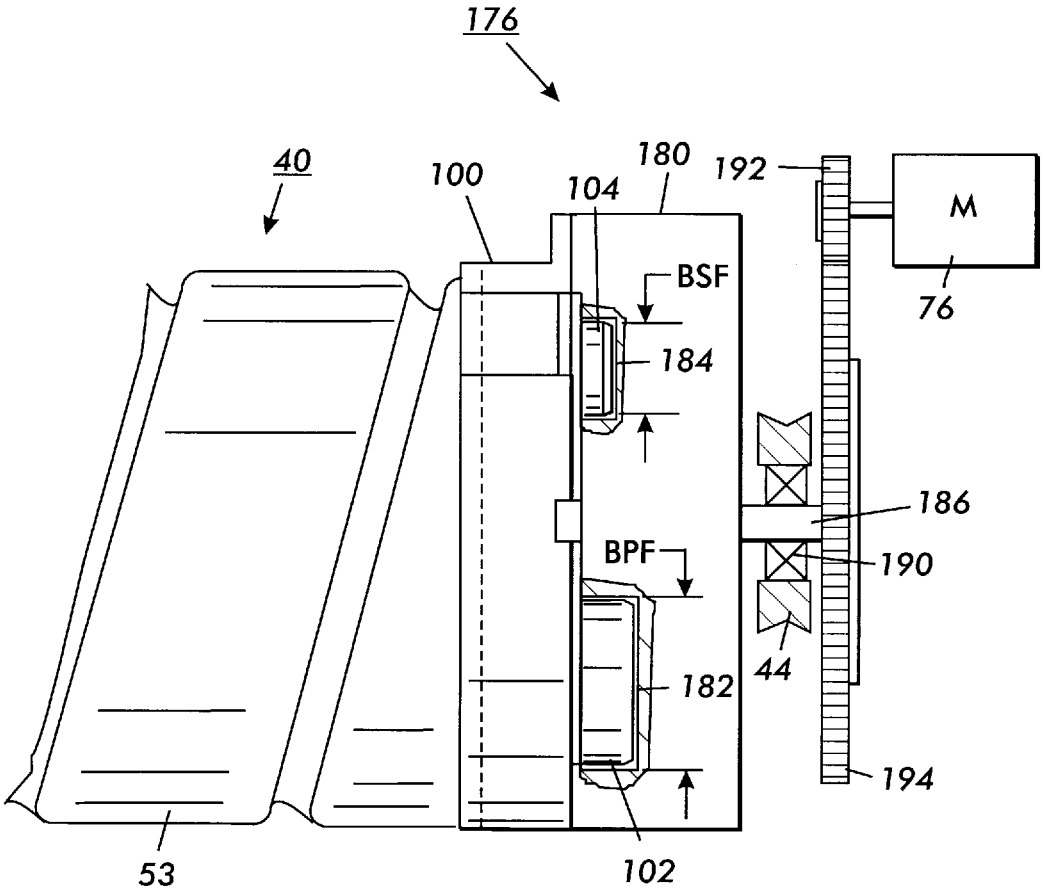
FIG. 8 is a partial plan view of the first adaptor of FIG. 4 in cooperation with a first toner container drive mechanism.

Referring now to FIG. 8, the toner container 53 with fool proof adapter is shown. The particle storage device 40 is rotated by the container drive motor 76 by the use of a first mechanism 176 which mechanically interconnects the container drive motor 76 with the particle storage device 40. The first mechanism 176 is connected to the particle storage device 40 through the use of the drive cap 100.

For example, as shown in FIG. 8, the first mechanism is connected to the first drive cap 100 by the use of a first toner container drive adapter 180. The toner container drive adapter 180 may have any suitable form capable of mating with the drive cap 100. For example for a drive cap 100 having a cylindrical shape and including a primary drive pin 102 and a secondary drive pin 104, the adapter 180 may be in the form of a cylinder and include a primary drive pin bore 182 cooperable with primary drive pin 102 of the drive cap 100. Preferably, similarly the adapter 180 may further include a secondary drive pin bore 184 cooperable with the secondary drive pin 104 of the drive cap 100.

For a primary drive pin with a diameter DPF of approximately 0.788 inches, the primary drive pin bore 182 of the adapter 180 may have a bore diameter BPF of approximately 0.788 inches. The primary drive pin 102 thus would matingly fit within the primary pin bore 182.

Similarly the secondary drive pin bore 184 may have a diameter BSF of approximately 0.393 inches when utilized with a drive cap 100 including a secondary drive pin 104 having a diameter DSF of approximately 0.393 inches.

The adapter 180 may be made of any suitable durable material for example a plastic or a metal. The adapter 180 is connected to the container drive motor 76 in any suitable fashion. For example the adapter 180 may be connected to a shaft 186 mounted to developer housing 44 by bearings 190.

The container drive motor 76 may be utilized to rotate drive gear 192 which meshes with driven gear 194. Driven gear 194 may be mechanically connected in any suitable fashion to shaft 186. Thereby with rotation of the container drive motor 76 the adapter 180 is caused to rotate thereby rotating the toner container 53.

Figure 9:
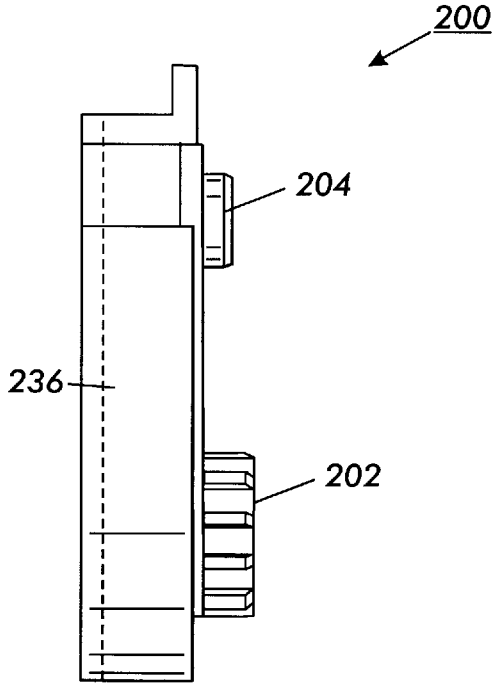
FIG. 9 is an end view of a second adapter for use with the toner container of FIG. 1.

Referring now to FIG. 9 a second member 200 in the form of a drive cap is shown. The second member 200 is mateably connectable to the toner container 53 of FIG. 1 in a manner similar to that of drive cap 100 of FIGS. 4–6. The second drive cap 200 may include a second drive cap interlock feature 236 which is substantially the same as interlock feature 136 of the first drive cap 100. Thus the drive caps 100 and 200 are interchangeable with a common toner container 53.

The second drive cap 200 preferably includes a feature whereby the drive cap 200 may be connected to container drive motor 76. For example the second drive cap 200 may include a primary drive pin 202 similar to primary pin 102 of cap 100.

Primary drive pin 202 preferably has a different shape or size such that the primary drive pin 202 is not matingly fitted to the primary pin bore 182 of the adapter 180 of FIG. 8. The second drive cap 200 may also include a secondary drive pin 204 which is similar to secondary drive pin 104 of the first drive cap 100.

Figure 10:
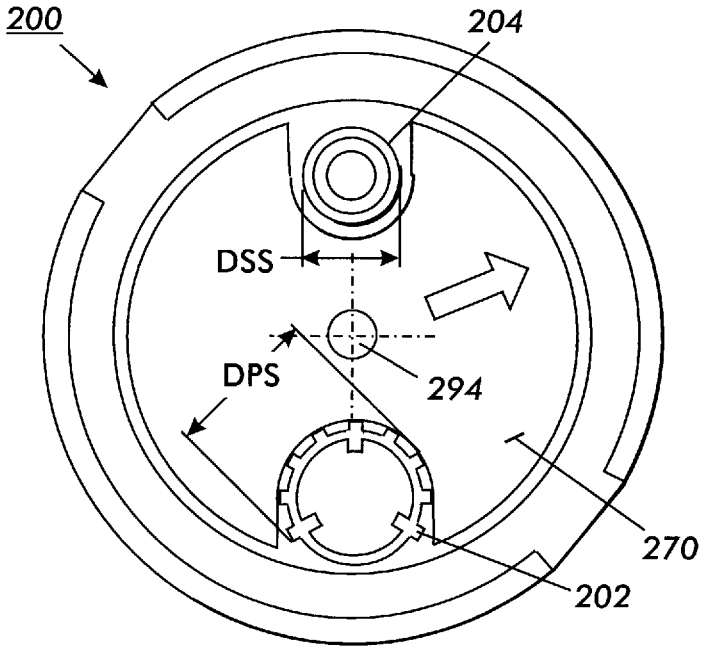
FIG. 10 is a plan view of the second adapter of FIG. 9.

Referring now to FIG. 10 the second drive cap 200 is shown in greater detail. The primary drive pin 202 for example as shown in FIG. 10 includes a diameter DPS which is substantially larger than the diameter DPF of the first drive cap 100 (see FIG. 5). For example, the diameter DPS may be 0.95 inches in diameter. Thus the primary drive pin 202 is substantially larger than the diameter DPF of the primary drive pin bore.

Referring again to FIG. 10 the secondary drive pin 204 may include a diameter DSS which may be, as shown in FIG. 10, similar to diameter DSF of the first drive cap 100.

The second drive pin 200 may likewise include an additional feature 294 in the form of a through hole in body 270 of the second drive cap 200. The hole 294 may be utilized to accommodate a stud (not shown) to permit the installation of the secondary drive cap 200 into a copier machine which stud will not fit with the first drive cap 100.

Figure 11:
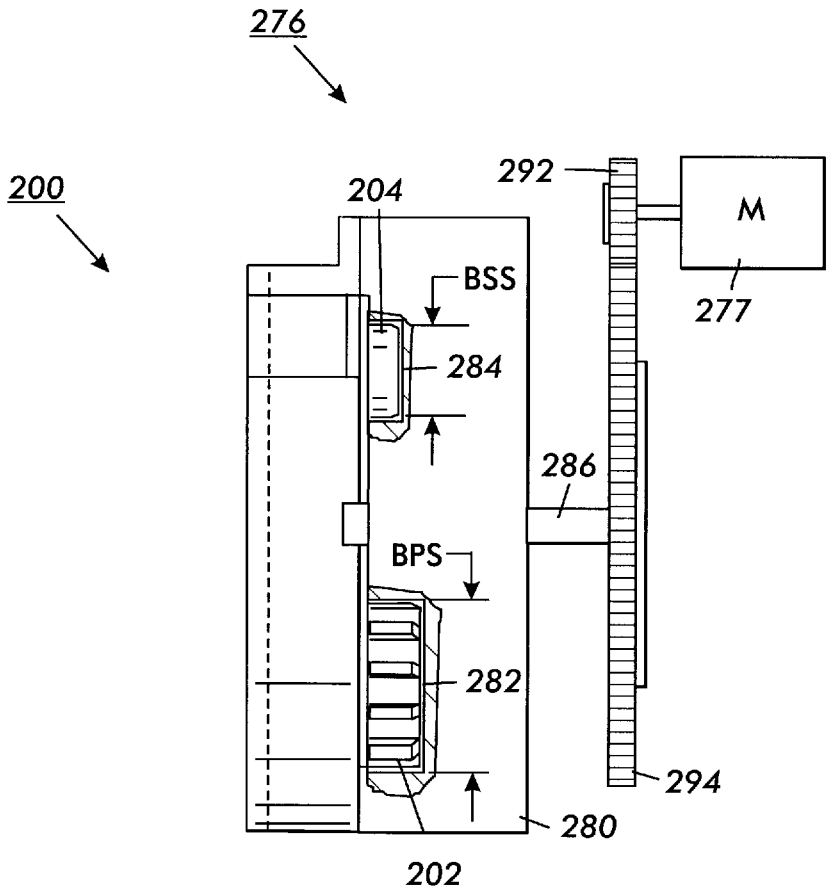
FIG. 11 is a partial plan view of the second adaptor of FIG. 9 in cooperation with a second toner container drive mechanism.

Referring now to FIG. 11 the second drive cap 200 is shown in connection with motor 277 of a second printing machine. The second drive cap 200 is similar to the first drive cap 100 and is connectable to the second container drive motor 277 by means of a second mechanism 276. The second mechanism 276 may be similar to the first mechanism 176 of FIG. 8. For example the second mechanism 176 may include a second drive gear 292 connected to a second driven gear 294. Gear 294 is connected to a shaft 286 to which second toner container drive adapter 280 is connected. The second toner container drive adapter 280 includes a feature to provide for connection of the adapter 280 to the second drive cap 200.

The connection feature of the second toner container drive adapter 280 may include, for example, a primary drive pin bore 282 adapted to fit with primary drive pin 202 of the drive cap 200 as well as a secondary drive pin bore 284 adapted to mate with a secondary drive pin 204 of the drive cap 200.

For example the primary drive pin bore 282 may have a diameter BPS similar to the diameter DPS of the primary drive pin 202 and the secondary drive pin bore 284 may have a diameter BSS similar to diameter DSS of the secondary drive pin 204.

Figure 12:
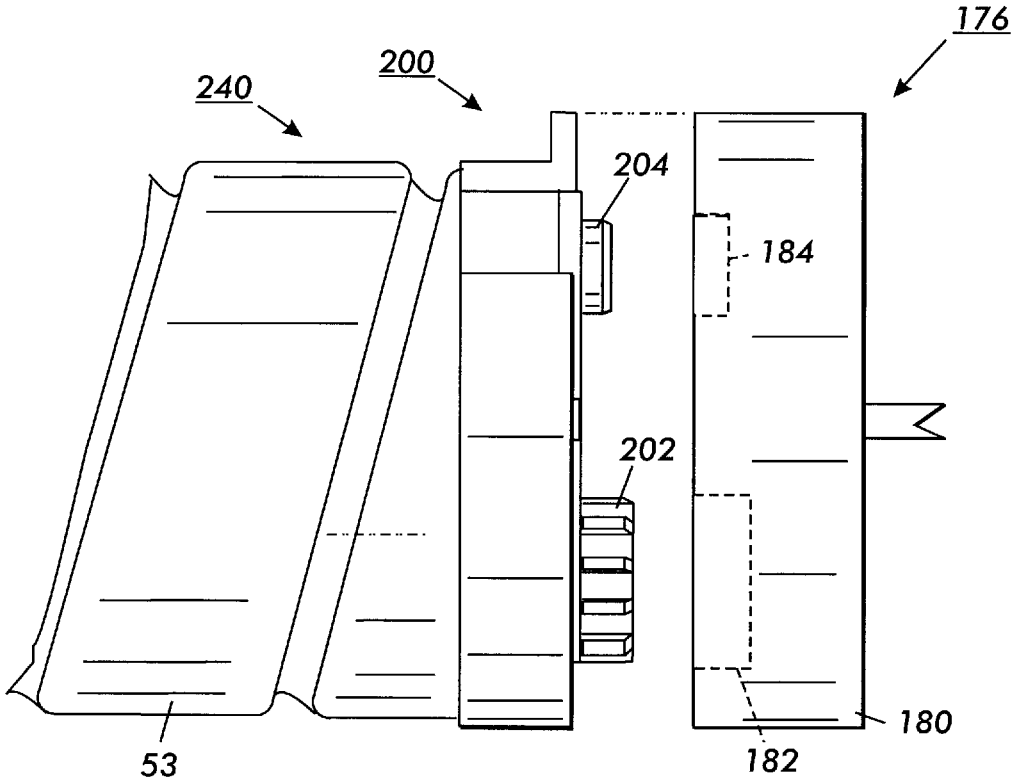
FIG. 12 is a partial plan view of the second adaptor of FIG. 9 illustrating the lack of computability of the second adaptor with the first toner container drive mechanism.

Referring now to FIG. 12 the second drive pin cap 200 is shown in an attempt to be installed within the first toner container drive mechanism 176 of the first copy machine 10. The first container drive mechanism 176 includes adapter 180. The adapter 180 includes the primary drive pin bore 182. As can be seen in FIG. 12 the primary drive pin bore 182 is significantly smaller than the second primary drive pin 202 of the second drive cap 200. The difference between the primary drive pin bore 182 and the primary drive pin 202 prevents the engagement of the second drive cap 200 into the first toner container drive mechanism 176. This prevents the second particle container 240 from being installed into the first copy machine 10.

Figure 13:
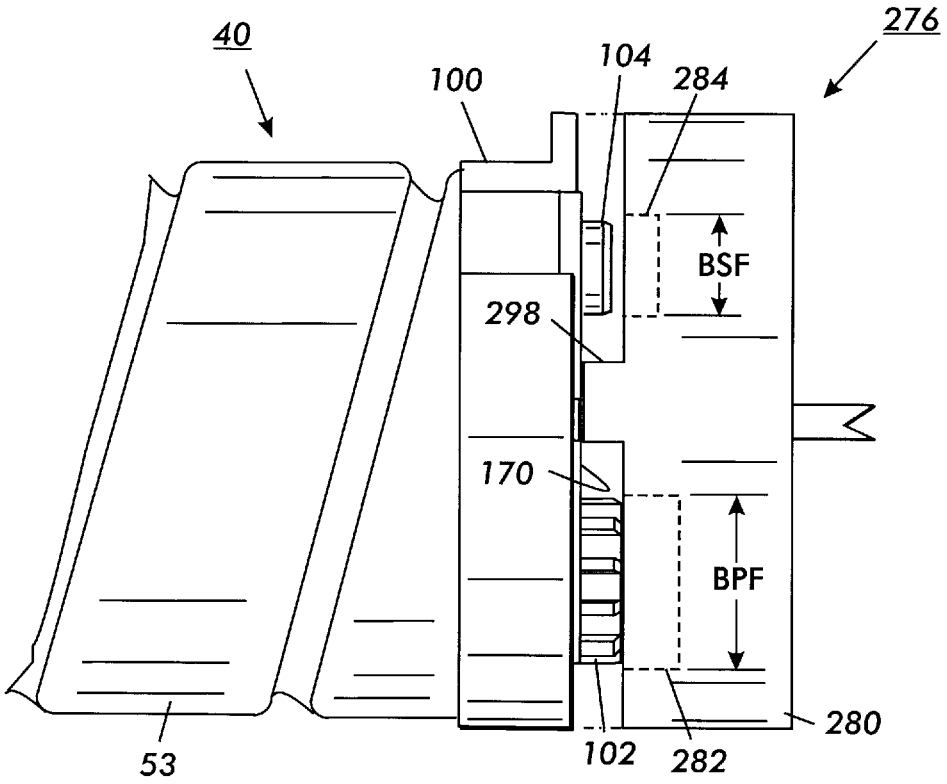
FIG. 13 is a partial plan view of the first adaptor of FIG. 4 illustrating the lack of computability of the first adaptor with the second toner container drive mechanism.

Referring now to FIG. 13 the first particle storage device 40 is shown in an attempt to being installed in a second printing machine 210. The first particle storage device 40 includes the first drive cap 100. The second printing machine 210 includes second drive mechanism 276. The second drive mechanism 276 includes second adapter 280. The second adapter 280 includes a primary drive pin bore 282 which is significantly larger than the primary drive pin 102 of the first drive cap 100. The secondary drive pin bore 284 is matingly fitted to the second drive pin 104 of the first drive cap 100.

The second adapter 280 thus preferably includes an additional feature in the form of a stud 298 which protrudes centrally from the adapter 280. The stud 298 contacts body 170 of the first drive cap 100 preventing the installation of the first particle storage device 40 into the second copy machine 210.

By providing a toner container with a replaceable adapter an adapter may be provided that does not require riveting or welding to the toner container body.

By providing a toner container with a replaceable adapter made of a material with greater strength than the toner container an inexpensive toner container may be provided that may be rotated when full of heavy marking particles.

By providing a toner container with a replaceable adapter that does not require tools or fasteners the assembly time to assemble the adapter into the toner container may be reduced.

By providing a toner container with a replaceable adapter a common molded container can be manufactured for use in different printing machines.

By providing a toner container with a replaceable adapter utilizing different adapters and a common toner container the high tooling cost associated with manufacturing a blow molded toner container may be reduced.

By providing a toner container with a replaceable adapter different copy machines may be manufactured with an identical toner container blow molded body.

By providing a toner container with a replaceable adapter utilizing a common toner container the cost of separable container molds may be avoided.

By providing a toner container with a replaceable adapter a common toner container may be provided which has low cost due to the large volume of usage of that common container.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

We claim:

1. A device for storing a supply of particles for use a developer unit of an electrophotographic printing machine, the device cooperable with a mechanism to feed the particles from the device into the developer unit, the device comprising:

a container defining a chamber for storing particles therein, said container defining an aperture therein; and a member removably connectable to said container, said container and said member being insertable into and removable from the mechanism with said container and said member connected to each other, said member including a member feature, said member feature being engagable with said mechanism for feeding the particles from the device into the developer unit.

2. A device according to claim 1, wherein said container is defined by a generally hollow cylindrical shape.

3. A device according to claim 1, further comprising a spiral member, a portion thereof located in said container for urging the particles in the chamber toward an end of the chamber.

4. A device according to claim 1, wherein said member is removably connectable to said container by movement of said member in a direction perpendicular to a longitudinal axis of said container.

5. A device according to claim 1, further comprising a second member removably connectable to said container, said second member including a second member feature, said first mentioned member feature being engagable with said mechanism for feeding the particles from the device into the developer unit and said second member feature not being engagable with said mechanism for feeding the particles from the device into the developer unit.

6. A device according to claim 1, wherein:

said container defines a first groove in the periphery of the container adjacent an end of the container;

said container defines a second groove in the periphery of the container adjacent the first end of the container and opposed to and parallel with the first groove; and said member comprises a first substantially linear portion thereof in substantially linear contact with said first groove and a second substantially linear portion thereof in substantially linear contact with said second groove for securing said member to said container.

7. The device according to claim 6:

wherein at least one of said first portion and said second portion comprise a protrusion extending therefrom; and wherein container defines at least one feature associated with at least one of said first groove and said second groove and cooperating with said protrusion for interlocking said member to said container.

8. A developer unit for developing a latent image recorded on an image receiving member of an electrophotographic printing machine with a supply of particles, the developer unit including a device for storing the supply of particles, the device cooperable with a mechanism to feed the particles from the device into the developer unit, the device comprising:

a container defining a chamber for storing particles therein, said container defining an aperture therein; and a member removably connectable to said container, said container and said member being insertable into and removable from the mechanism with said container and said member connected to each other, said member including a member feature, said member feature being engagable with said mechanism for feeding the particles from the device into the developer unit.

9. A developer unit according to claim 8, wherein said container is defined by a generally hollow cylindrical shape.

10. A developer unit according to claim 8, further comprising a spiral member, a portion thereof located in said container for urging the particles in the chamber toward an end of the chamber.

11. A developer unit according to claim 8, wherein said member is removably connectable to said container by movement of said member in a direction perpendicular to a longitudinal axis of said container.

12. A developer unit according to claim 8, further comprising a second member removably connectable to said container, said second member including a second member feature, said first mentioned member feature being engagable with said mechanism for feeding the particles from the device into the developer unit and said second member feature not being engagable with said mechanism for feeding the particles from the device into the developer unit.

13. A developer unit according to claim 8, wherein:

said container defines a first groove in the periphery of the container adjacent an end of the container;

said container defines a second groove in the periphery of the container adjacent the first end of the container and opposed to and parallel with the first groove; and said member comprises a first substantially linear portion thereof in substantially linear contact with said first groove and a second substantially linear portion thereof in substantially linear contact with said second groove for securing said member to said container.

14. The developer unit according to claim 13:

wherein at least one of said first portion and said second portion comprise a protrusion extending therefrom; and wherein container defines at least one feature associated with at least one of said first groove and said second groove and cooperating with said protrusion for interlocking said member to said container.

15. An electrophotographic printing machine for developing with a supply of particles a latent image recorded on an image receiving member, said printing machine including a developer unit, the developer unit including a device for storing the supply of particles, the device cooperable with a mechanism to feed the particles from the device into the developer unit, the device comprising:

a container defining a chamber for storing particles therein, said container defining an aperture therein; and a member removably connectable to said container, said container and said member being insertable into and removable from the mechanism with said container and said member connected to each other, said member including a member feature, said member feature being engagable with said mechanism for feeding the particles from the device into the developer unit.

16. A printing machine according to claim 15, wherein said container is defined by a generally hollow cylindrical shape.

17. A printing machine according to claim 15, further comprising a spiral member, a portion thereof located in said container for urging the particles in the chamber toward an end of the chamber.

18. A printing machine according to claim 15, wherein said member is removably connectable to said container by movement of said member in a direction perpendicular to a longitudinal axis of said container.

19. A printing machine according to claim 15, further comprising a second member removably connectable to said container, said second member including a second member feature, said first mentioned member feature being engagable with said mechanism for feeding the particles from the device into the developer unit and said second member feature not being engagable with said mechanism for feeding the particles from the device into the developer unit.

20. A printing machine according to claim 15, wherein:

said container defines a first groove in the periphery of the container adjacent an end of the container;

said container defines a second groove in the periphery of the container adjacent the first end of the container and opposed to and parallel with the first groove; and said member comprises a first substantially linear portion thereof in substantially linear contact with said first groove and a second substantially linear portion thereof in substantially linear contact with said second groove for securing said member to said container.

21. The printing machine according to claim 20:

wherein at least one of said first portion and said second portion comprise a protrusion extending therefrom; and wherein container defines at least one feature associated with at least one of said first groove and said second groove and cooperating with said protrusion for interlocking said member to said container.

* * * * *